US006578402B2

(12) United States Patent
Weil

(10) Patent No.: US 6,578,402 B2
(45) Date of Patent: Jun. 17, 2003

(54) TRIMMING APPARATUS FOR A DRAWN PART

(75) Inventor: Bernard C. Weil, Denver, CO (US)

(73) Assignee: MedSource Technologies, LLC, Englewood, CO (US)

( * ) Notice: Subject to any disclaimer, the term of this patent is extended or adjusted under 35 U.S.C. 154(b) by 0 days.

(21) Appl. No.: 09/821,424

(22) Filed: Mar. 28, 2001

(65) Prior Publication Data

US 2002/0178777 A1 Dec. 5, 2002

(51) Int. Cl.[7] ..... B28D 28/00

(52) U.S. Cl. ..... 72/334; 72/332; 83/186; 83/190; 83/194

(58) Field of Search ..... 72/328, 326, 332, 72/334; 83/185, 186, 190, 191, 194

(56) References Cited

U.S. PATENT DOCUMENTS

| | | | | | |
|---|---|---|---|---|---|
| 1,396,230 | A | * | 11/1921 | Peterson | 83/186 |
| 1,524,183 | A | | 1/1925 | Knaebel | |
| 1,717,612 | A | * | 6/1929 | McNeil | 83/190 |
| 2,315,340 | A | * | 3/1943 | Knudsen | 83/185 |
| 2,321,085 | A | | 6/1943 | Hubbard | 29/148.2 |
| 2,374,301 | A | * | 4/1945 | Olney | 83/181 |
| 2,570,919 | A | * | 10/1951 | Clifford | 72/326 |
| 2,611,475 | A | | 9/1952 | Slater | 205/7 |
| 3,580,122 | A | * | 5/1971 | Powell | 83/182 |
| 3,646,840 | A | | 3/1972 | Bozek | 82/82 |
| 3,839,933 | A | | 10/1974 | Paramonoff | 82/61 |
| 3,956,814 | A | | 5/1976 | Peet | 29/414 |
| 4,257,293 | A | | 3/1981 | Stahl | 83/193 |
| 4,485,661 | A | | 12/1984 | Hehl | 72/332 |
| 4,489,584 | A | | 12/1984 | Gall et al. | 72/327 |
| 4,802,393 | A | * | 2/1989 | Gruchalski et al. | 83/184 |
| 5,287,713 | A | | 2/1994 | Mine et al. | 72/43 |

FOREIGN PATENT DOCUMENTS

| | | | | |
|---|---|---|---|---|
| FR | 795211 | * | 3/1936 | 83/191 |
| SU | 553059 | * | 5/1977 | 83/185 |

* cited by examiner

*Primary Examiner*—Daniel C. Crane

(57) ABSTRACT

A trim die for sheet metal or other materials is provided to trim the entire circumference of a drawn part. The trim die includes a trim plate with a connected trim punch moveably mounted in a stripper plate. Cam punches with cam lobes engage cam followers on the trim plate to impart motion to the trim die. The trim die of the present invention minimizes displacement of the part to be trimmed, including the excess material, and therefore is compatible with progressive dies. The corresponding method of trimming a part is also provided.

6 Claims, 6 Drawing Sheets

TRIMMING APPARATUS FOR A DRAWN PART

FIELD OF THE INVENTION

The present invention relates in general to the manufacturing of drawn sheet metal parts in a press, and, more particularly, relates to an apparatus and method for trimming the circumference of a drawn part as a result of vertical movement of the press.

BACKGROUND OF THE INVENTION

Sheet metal parts have been made with dies that run in presses for decades. Dies are typically comprised of a fixed lower die portion and an upper punch portion which is reciprocally movable with respect to the lower die portion. The upper punch portion is typically connected to the ram of a press. The ram is generally slidably mounted within rails along either side of a press which constrain the ram to vertical movement therein. In addition, a motor having an output shaft is provided on the press. The output shaft typically has a distal end provided with a concentrically mounted plate thereon which, in turn, is connected to an eccentric crankshaft. Further, the ram has one end mounted to an upper surface of the punch portion of the die and on opposite end having a bearing which is journaled to the crankshaft. Thus, as rotational motion is imparted to the output shaft by the motor, the crankshaft is rotated as well and traces a circular path. As a result, the ram, in conjunction with the upper punch portion of the die, is moved reciprocally within the rails with respect to the lower die portion.

Each rotation of the output shaft of the motor is relative to the "stroke" of the machine and ranges between 0 and 360 degrees. Thus, the point at which the eccentric portions of the crankshaft are located at the uppermost vertical position with respect to the plate is referred to as the 0 degree position or "top dead center" (TDC). At TDC, the upper punch portion of the die is positioned the greatest extent above the lower die portion. The point at which the eccentric portions of the crankshaft are located adjacent to the lowermost vertical position with respect to the plate is referred to as the 180 degree position or "bottom dead center" (BDC). In the 180 degree position, the upper punch portion is positioned adjacent to the lower die portion and is the position whereby the forming operations are performed on the part. The distance the ram travels from TDC to BDC is referred to as the "stroke" of the press.

Dies have been developed that pierce, form, draw, and trim sheet metal to produce a part of a desired shape. As the state of the art has progressed, dies have been developed to combine some of these operations in a single die. Other dies, called progressive dies, have been developed that combine several die stations on a common base to be operated within a single press. A progressive die performs a series of fundamental sheet metal operations at two or more stations in the die during each press stroke. These simultaneous operations produce a part from a strip of material that moves through each die. Each working station performs one or more die operations such as shaping, piercing or drawing the strip of stock material, but the strip must move from the first station through each succeeding station in a substantially linear path to produce a complete part.

The advancement of sheet metal dies has also seen the development of dies which are capable of trimming a part, i.e., removing excess material from a completed part, in a direction substantially perpendicular to the stroke of the press. In these operations, cams or other actuating means are typically employed to impart movement of at least one of the trimming surfaces. Unfortunately, the cams typically actuate a large portion of the die while significantly moving the entire part relative to the die or press. Thus, incorporation of cam trim dies in a progressive die is substantially impossible since the strip of material constrains movement of the part and the strip of material is moving in a linear path. Moreover, excess movement of the strip may affect the operations in other stations in the progressive die. Additionally, the large movement is difficult in progressive dies because of the speed of operation. Progressive dies are often operated in presses running at between 30 and 200 strokes per minute. Often, there is simply not enough time for a large movement of the tooling in a single press stroke.

Other cam trim dies have been developed which require less movement of the die or part. However, these cam trim dies typically have complex actuating means and require more time to index the trim surfaces or elements, and are thus not practical in many progressive dies. As stated above, progressive dies are often operated at between 30 and 200 strokes per minute. As the speed of the press increases, the speed of the actuating means proportionally increases. Often, the speed of the press does not allow for the use complex trim actuating means due to time constraints. Further, to attain these high press speeds, the stroke length of the press must be limited. Adaption of both complex actuating means and dies with large movements to progressive dies can be problematic when stroke lengths are relatively small.

In view of the above, there is a long felt but unsolved need for a sheet metal trim die that avoids the above-mentioned deficiencies of the prior art and provides a simple sheet metal die which is capable of trimming the entire circumference of a drawn part in a direction which is oriented perpendicular to the operation of a reciprocating press while limiting movement of the part.

SUMMARY OF THE INVENTION

Accordingly, it is an object of the present invention to provide a sheet metal die which is capable of trimming the entire circumference of a drawn part in a single stroke of a press which imparts insignificant motion to the part. The limited motion of the part may facilitate use of the trim die in combination with various transfer mechanisms to deliver the part to and from the die or as one of numerous stations in a progressive die.

Another object of the present invention is to provide a trim die in which the moving trim surfaces are contained within a portion of the die itself. The movement of an internal portion of the die obviates the need for movement of large portions of the die and, thus, provides the benefit of minimal space requirements, increased operating speeds, and decreased stroke length requirements.

Yet another aspect of the present invention is to provide a trim actuating mechanism which can be used in one of a plurality of stations of a progressive die to trim a circumference of a drawn part. The achievement of the objects mentioned above facilitate the use of the present invention in a progressive die. More specifically, the use of the present invention in a progressive die may eliminate additional stations or operations currently required in progressive dies for trimming the circumference of a drawn part. For example, it is commonly necessary for a progressive die to trim excess material from a drawn part in a direction parallel to the motion of the press. It then becomes necessary to perform a wiping operation to bring the flange created by trimming back into alignment with the drawn edge. The use of the present invention would make the wiping operation unnecessary.

These and other objects of the present invention are fulfilled by providing a die assembly including a punch plate having a plurality of cam punches interconnected thereto, the plurality of cam punches each having a cam lobe. Further, a die plate is provided which has a part recess sized to receive at least a portion of the drawn part, the upper circumference of the part recess forming an exterior trim edge, a stripper plate sub-assembly (hereinafter the "stripper plate") moveably interconnected to the punch plate and having a plurality of apertures for receiving the cam punches, and a trim plate horizontally moveably mounted in the stripper plate and having a plurality of lateral sides and a trim punch. The cam punches move the trim plate horizontally with respect to a longitudinal axis of the cam punches by engaging the lateral sides of the trim plate with the cam lobes as the stripper plate is moved toward the punch plate. The excess material is trimmed from at least a portion of the circumference of the drawn part by the movement of the trim punch relative to the exterior trim edge.

Thus, in one aspect of the present invention, a method adapted for progressively forming and trimming a part in a reciprocating die press from a strip of stock material is provided comprising the steps of introducing a strip of stock material into the reciprocating press having one or more progressive stations in series to draw, shape, pierce or otherwise form a portion of the strip of stock material; cycling the press to perform at least one operation on said strip of stock material, wherein a portion of the strip of stock material is drawn, shaped, pierced or otherwise formed into a desired shape; advancing the desired shape into a trimming station which is operably interconnected to the press; and trimming any excess of the strip of stock material from the desired shape as the press reciprocates.

Additional advantages of the present invention will become readily apparent from the following discussion, particularly when taken together with the accompanying drawings.

DETAILED DESCRIPTION

Figure 1:
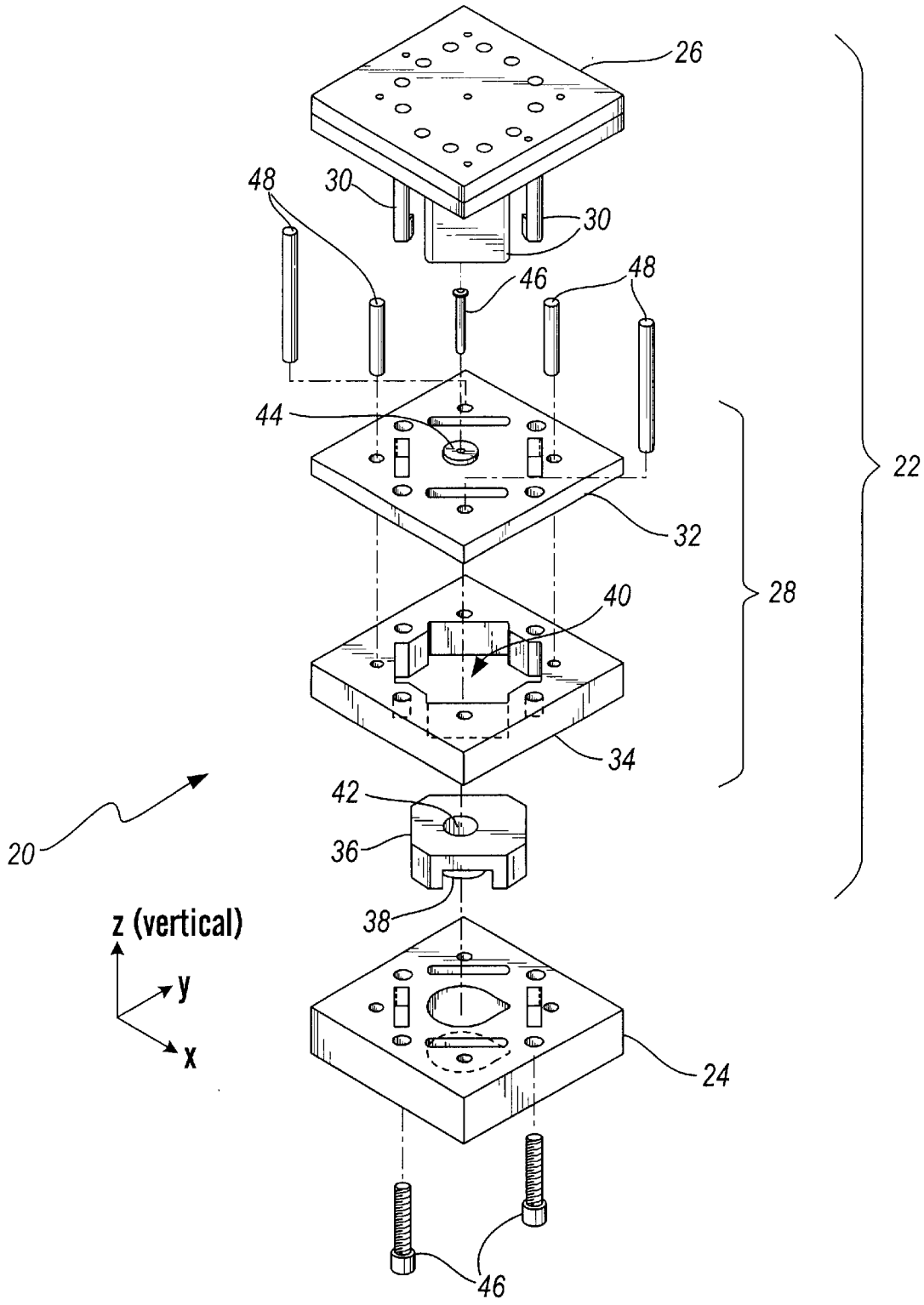
FIG. 1 is an exploded perspective view of one embodiment of the present invention.

Referring now to the drawings, and FIG. 1 in particular, one possible embodiment of the cam trim die 20 of the present invention is shown. The trim die 20 is generally comprised of a punch portion 22 and a die plate 24. The punch portion 22 is further comprised of a punch plate 26 and a stripper plate 28. The punch plate 26 includes a plurality of cam punches 30 attached thereto. In the embodiment of FIG. 1, the stripper plate 28 includes a punch guide plate 32 and a trim plate carrier 34. The trim plate carrier 34 is connected to and adjacent the punch guide plate 32. A trim plate 36, with a trim punch 38 connected thereto, is moveably positioned within the trim plate cavity 40 of the trim plate carrier 34 and connected through a trim plate aperture 42 by a spool 44 to the punch guide plate 32. The stripper plate 28 has thus the two-fold task of guiding the cam punches 30 as they move vertically, and to restrain the horizontal motion of the trim plate 36 while the trimming process occurs. The clearance between the trim plate aperture 42 and the outer diameter of the spool 44 is such that the trim plate 36 may move relative to the stripper plate 28. The components of the trim die 20, where required, may be connected by screws 46 or other fastening devices and mechanisms commonly known in the art. Similarly, relative positions between various components may be maintained by dowels 48. Other components (not shown) may also be included in the cam die. For example, springs, pneumatic or hydraulic cylinders, or other similar devices may be used to bias the stripper plate 28 away from the punch plate 26. The biasing force of the springs, or cylinders, is overcome by the press when the punch portion 22 of the die is moved toward the die plate 24 and the stripper plate 28 contacts the die plate 24 as the ram of the press approaches bottom dead center. The stripper plate 28 is typically constrained to a maximum distance from the punch plate 26 by stripper bolts or spools.

Figure 2:
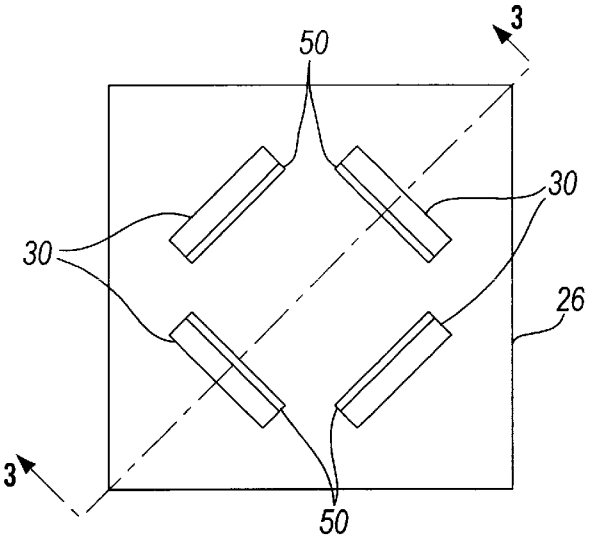
FIG. 2 is a bottom plan view of one embodiment of the punch plate of the present invention.

Referring now to FIG. 2, one embodiment of the punch plate 26 of the present invention is shown in bottom plan view. Cam punches 30 are interconnected to the punch plate 26 and extend perpendicular therefrom. The cam punches 30 may be attached to the punch plate 26 in any known manner, e.g., screws, bolts, press fit, etc. Typically, the cam punches 30 will be attached to the punch plate 26 by screws so that the cam punches may be easily removed and replaced as the cam punches 30 become worn or broken. Further, the cam punches 30 may be counter set into the punch plate 26 to provide additional stability to the cam punches 30. Moreover, the punch plate 26 may be of a two piece construction (not shown), the first piece of the punch plate 26 being solid in the area of the cam punches 30 and the second piece having a aperture for receiving the cam punches 30. In this way, the cam punches 30 may be countersunk into the second piece of the punch plate 26, while minimizing the difficulty or time of machining the countersink holes. The apertures in the second piece in this construction may be sized to provide either a press fit or slip fit between the cam punches 30 and the countersink apertures. The punch plate 26 may further include, as necessary, additional holes or machined areas for attachment and clearances for die springs, stripper bolts, or other components.

With continued reference to FIG. 2, it is noted that the cam punches 30 may have different widths. The variation in width of the cam punches 30 may provide a die assembler with a fail proof method of aligning the punch plate 26, and thus the cam punches 30, with the other components of the trim die 20. The combination of the components is explained in greater detail below.

Figure 3:
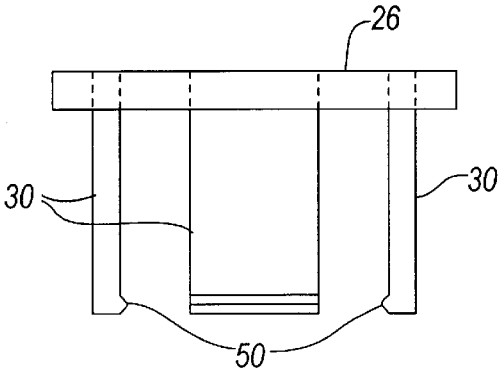
FIG. 3 is a cross-sectional view of the punch plate of FIG. 2.

Referring now to FIGS. 1 and 3, cross-sectional view of the punch plate 26 and cam punches 30 of FIG. 2 is shown as taken along line 3—3. In this embodiment, the punch plate 26 is of one-piece construction. The cam punches 30 are countersunk into punch plate 26. Typically, the cam punches 30 will be countersunk the entire thickness of the punch plate 26. Cam lobes 50 are provided at the lower end of the cam punches 30. The cam lobes 50, as explained more fully below, will engage corresponding cam followers 52 on the trim plate 36 when the punch plate 26 is moved in a vertical stroke relative to the top surface 53 of the die plate 24 which in turn imparts substantially horizontal motion, parallel to the top surface 53 of the die plate 24, to the trim plate 36. The cam punches 30 as provided herein are provided with different lengths. Thus, as the press strokes, and the punch plate 26 is indexed toward the stripper plate 28 (not shown) in contact with the die plate 24, the direction of motion imparted to the trim plate 36 is varied throughout a portion of the press stroke.

Figure 4:
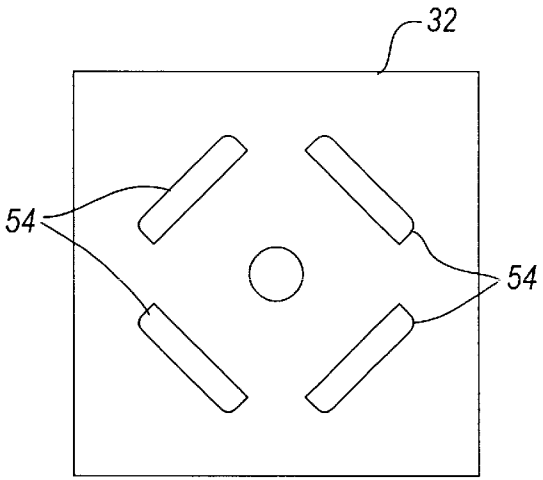
FIG. 4 is a bottom plan view of one embodiment of the punch guide plate of the present invention.

With reference now to FIG. 4, one particular embodiment of the punch guide plate 32 is shown. The punch guide plate 32 includes cam punch apertures 54. The cam punch apertures 54 are sized to receive the cam punches 30 and yet allow the punch guide plate 32 to travel relative to the punch plate 26. If the above-mentioned embodiment of cam punches 30 of various widths is employed, the cam punch apertures 54 may also have corresponding widths, with sufficient clearance as necessary to prevent incorrect assembly of the punch plate 36 with the punch guide plate 32. In this embodiment, the trim punch 36 will be moveably connected to the punch guide plate 32. Typically, a spool 44 will connect the trim punch 36 to the punch guide plate 32. The punch guide plate 32 may include additional holes or machined areas for attachment and clearances for the trim punch 36, die springs, stripper bolts, or other components.

Figure 5:
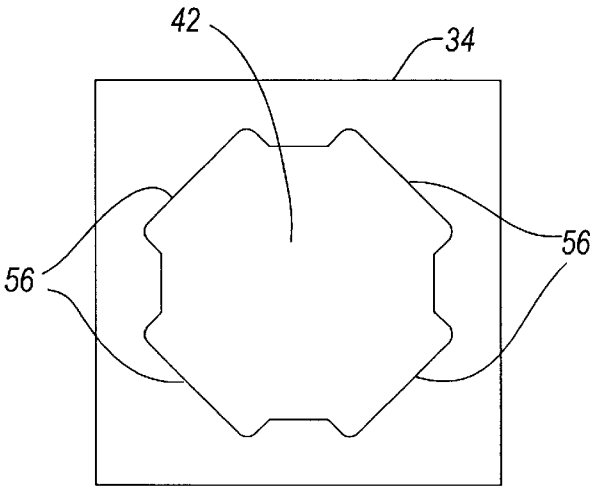
FIG. 5 is a bottom plan view of one embodiment of the trim plate carrier of the present invention.

Referring now to FIG. 5, one embodiment of the trim plate carrier 34 is shown in bottom plan view. The trim plate carrier 34 has a trim plate aperture 42 for receiving the trim plate 36. The trim plate aperture 42 is sized to allow the trim plate to move horizontally with respect to the reciprocating vertical press to the extent necessary to carry out the trimming operation, i.e., the range of motion imparted to the trim plate 36 by the cam punches 30. The trim plate aperture 42 also includes cam punch recesses 56 to allow travel of the cam punches 30 relative to the trim plate carrier 34. The cam punch recesses 56 of the trim plate carrier 34 should align with the cam punch apertures 54 of the punch guide plate 32 when the trim plate carrier 34 and the punch guide plate 32 are connected to form the stripper plate 28. Again, the trim plate carrier 34 may include additional holes or machined areas, as necessary, for attachment and clearances for die springs, stripper bolts, or other components.

It should be noted that the present invention could be constructed with the stripper plate 28 made of a one-piece component equivalent to the trim plate carrier 34 and punch guide plate 32 combination. However, the difficulty of and/or time required for machining may make the two-piece construction a much more viable alternative.

Figure 6:
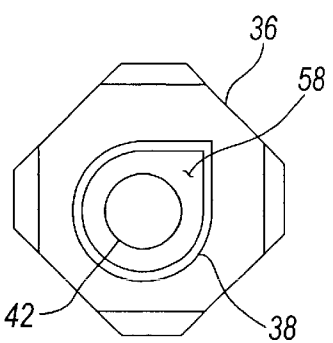
FIG. 6 is a bottom plan view of one embodiment of the trim plate of the present invention.

Referring now to FIG. 6, one embodiment of the trim plate 36 is shown in bottom plan view. The trim plate 36 has lateral sides corresponding to the cam punches 30. The trim plate 36 may also include a trim punch clearance hole 58 which corresponds to the trim punch 38, and which dictates the geometric shape of the part being formed. A portion of the trim punch 38 must extend from the trim plate 36 in order to accomplish the trimming operation of the trim die 20. Typically, the trim punch 38 will be press fit into the trim plate 36, although other clearances between the two parts are possible. The trim punch 38 may be mounted on the lower surface of the trim plate 36, however, the placement of a portion of the trim punch 38 into the trim plate 36 provides additional stability to the trim punch 38 during the trimming operation.

Figure 7:
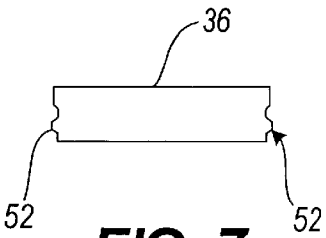
FIG. 7 is cross-sectional view of the trim plate of FIG. 6.

With reference now to FIG. 7, the trim plate 36 of FIG. 6 is shown in side elevation view. The trim plate 36 includes cam followers 52 on each lateral side corresponding to cam punches 30. The cam lobes 50 of cam punches 30 engage the cam followers 52 as the punch plate 24 moves toward the stripper plate 28 in contact with the die plate 24. The cam lobes 50 impart motion to the trim plate 36 when the cam lobes 50 are contact the most outward surface of the cam followers 52. Typically, the cam followers 52, as well as the cam lobes 50, have a transition area, i.e., a ramp, to prevent shock or damage to the cam lobes 50 or followers 52. It should also be noted that the cam followers 52 on the trim plate 36 may be provided at the same distance from either surface of the trim plate 36 if cam punches 30 of different lengths are used. In this scenario, the length of the cam punches 30 provide the timing of the motion of the trim plate 36. It is possible, however, to vary the distance of the cam followers 52 from the surfaces of the trim plate 36 and provide cam punches 30 of equivalent lengths, or even vary both the length of the cam punches 30 and the distance of the cam followers 52 from the surface of the trim plate 36. The timing of the motion of the trim plate 36 may be more readily determined, and more easily designed and manufactured, however, if only the length of the cam punches is varied.

Figure 8:
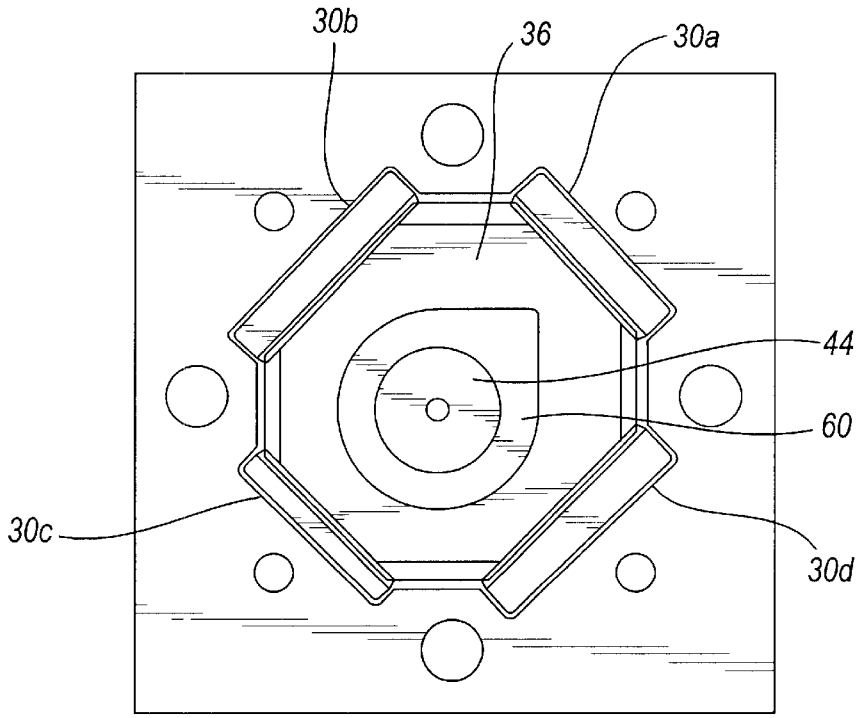
FIG. 8 is a bottom plan view of the punch portion of one embodiment of the present invention with the trim punch shown in the centered position.

Referring now to FIGS. 8–13, the interaction of the cam punches 30 and the trim plate 36 to impart motion to the trim punch 38 is shown. For clarity, the various cam punches will be designated as 30*a*, 30*b*, 30*c*, and 30*d* in these views. The corresponding cam lobes 50 and cam followers 52 will be similarly designated. FIGS. 8–12 are bottom plan views of the punch portion 22 of the trim die 20 shown with the trim plate 36, and thus the trim punch 38, in various positions. FIG. 8 shows the trim punch 38 in the centered position, that is, not indexed in any direction because the cam lobes 50 of the cam punches 30 are not in contact with the corresponding cam followers 52.

Figure 9:
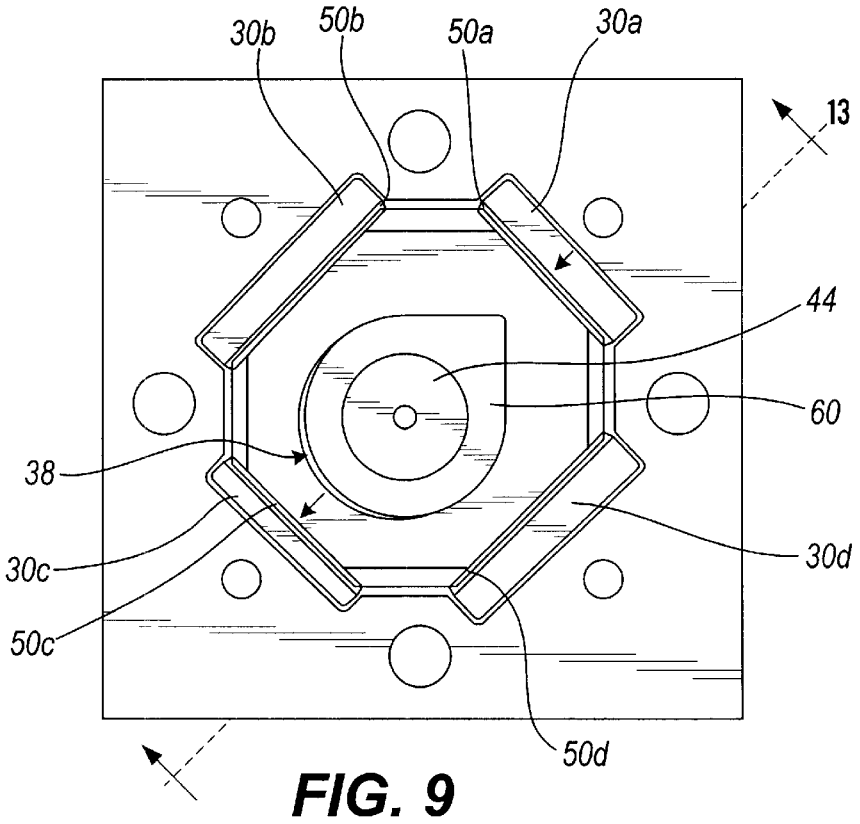
FIG. 9 is a bottom plan view of the punch portion of one embodiment of the present invention with the trim punch shown indexed in a first direction as shown by the arrows.

With reference to FIG. 9, the trim punch 38 is shown indexed to the lower left of the drawing. The trim punch 38 is indexed in this manner because the cam lobe 50 of cam punch 30*a* is in contact with the outermost surface of the corresponding cam follower 52*a*. The travel of the trim punch can be seen relative to the pilot 60 connected to the spool 44 at the end opposite the punch guide plate 34. The pilot 60 will nest in the cavity of the drawn part to facilitate proper location of the part relative to the trim punch 38. This nesting will be discussed in greater detail below.

Figure 10:
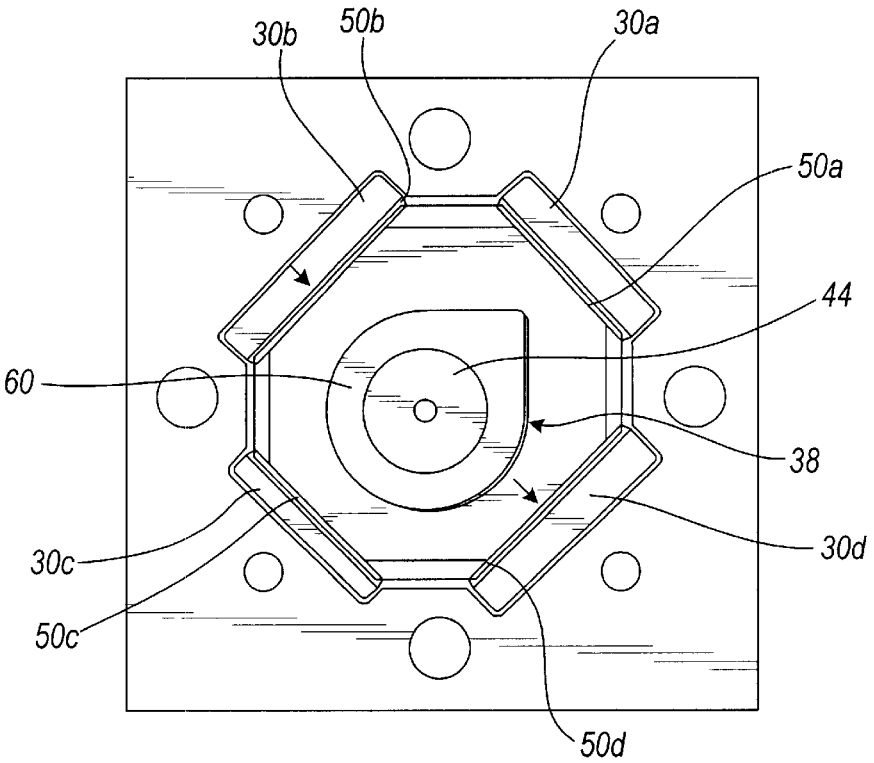
FIG. 10 is a bottom plan view of the punch portion of one embodiment of the present invention with the trim punch shown indexed in a second direction as shown by the arrows.
Figure 11:
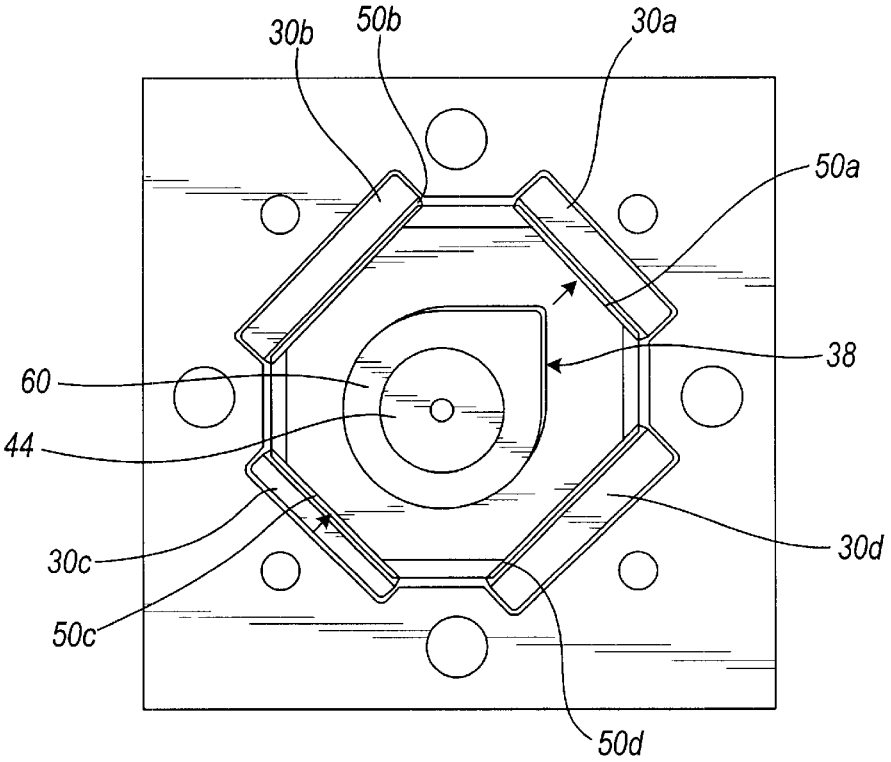
FIG. 11 is a bottom plan view of the punch portion of one embodiment of the present invention with the trim punch shown indexed in a third direction as shown by the arrows.
Figure 12:
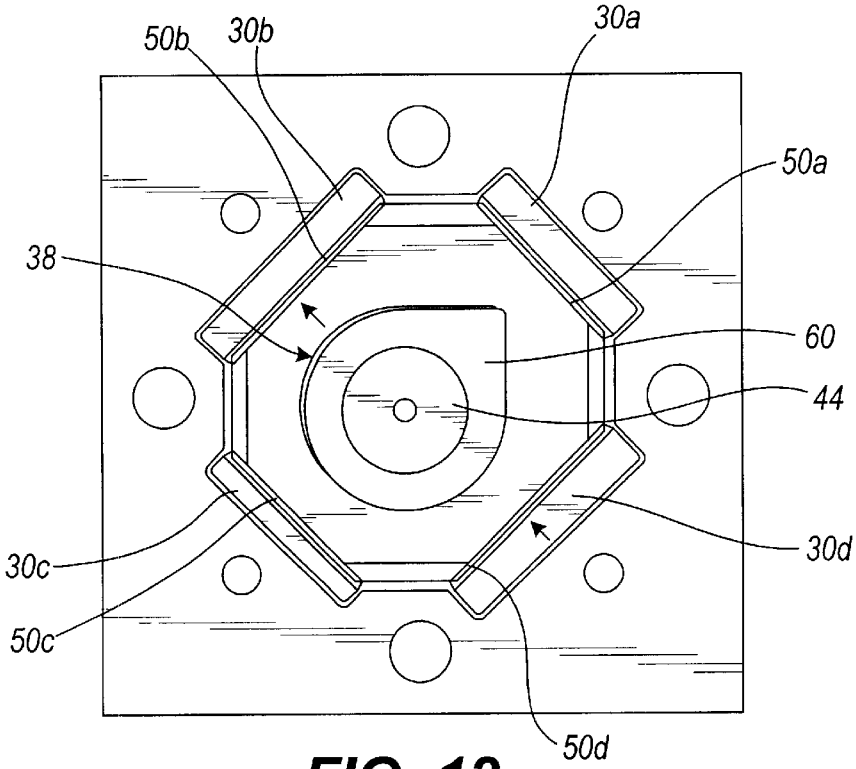
FIG. 12 is a bottom plan view of the punch portion of one embodiment of the present invention with the trim punch shown indexed in a fourth direction as shown by the arrows.

With reference to FIG. 10, the trim punch 38 is shown indexed to the lower right of the drawing. The trim punch 38 is indexed in this direction because the cam lobe 50*b* of cam punch 30*b* is in contact with the outermost surface of the adjacent cam follower 52*b*. Similarly, in FIGS. 11 and 12, the trim punch 38 is shown indexed to the upper right and upper left, respectively, of the drawings. Again, this is because the cam lobes 50*c* and 50*d* are in contact with the outermost surfaces of cam followers 52*c* and 52*d*, respectively.

Typically, the respective cam punches 30, via cam lobes 50, will engage the corresponding cam followers 52 in a clockwise, or counterclockwise, order. This type of ordering provides an almost circular motion to the trim punch 38 and thereby promotes a continual trimming motion and a more consisted trim edge, e.g., fewer burrs or slivers are created on the part. Thus in operation, as the press reciprocates the trim plate 36 and the trim punch 38 are successively indexed by, in an arbitrarily designated fashion, first a north cam punch 30*a*, second a west cam punch 30*b*, third a south cam punch 30*c*, and fourth a east cam punch 30*d*. Although this progression of indexing more closely resembles the following of the circumference of a square, the trim plate movement appears to be almost circular, or at least eccentrically circular, because of the rapidity of movement. The rapidity of the movement will, of course, be based primarily on the speed of the press (strokes/minute) and that portion of the stroke in which the movement occurs.

Figure 13:
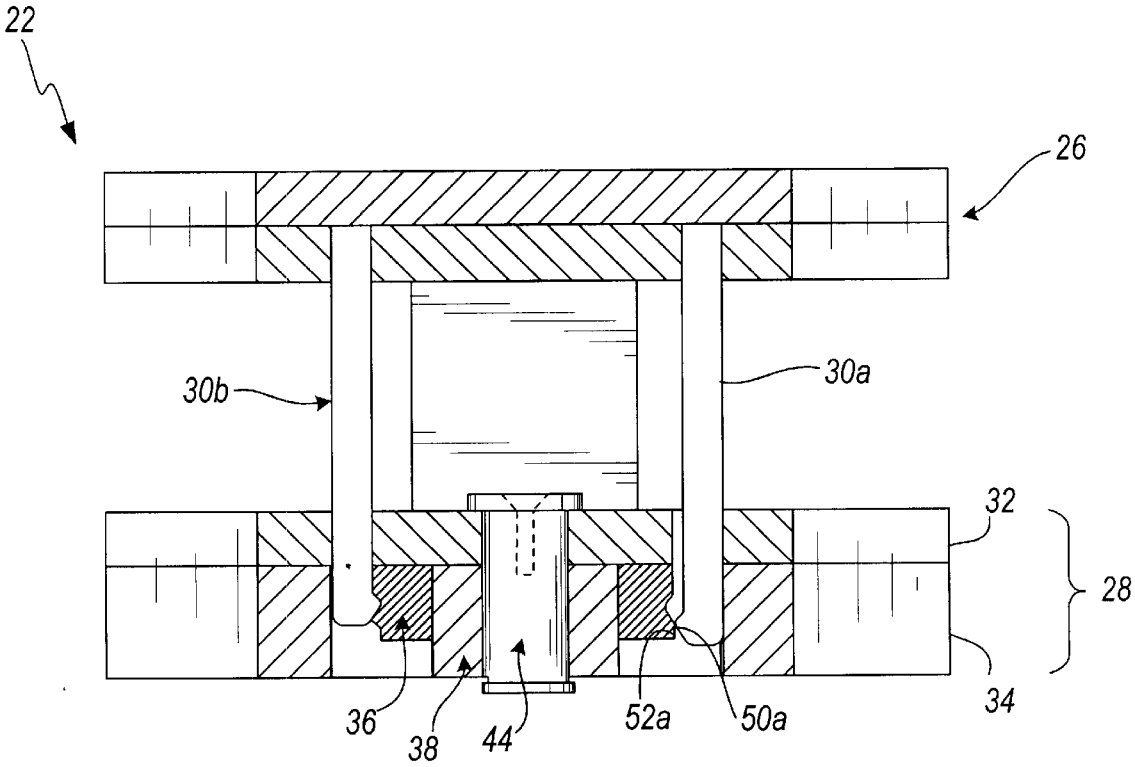
FIG. 13 is a cross-sectional view of one embodiment of the punch portion of the present invention taken along the plane indicated in FIG. 9.

With reference to FIG. 13, a cross-sectional view of the punch portion 22 of the trim die 20 of FIG. 9 is shown. In this view, it can be seen that the engagement of cam lobe 50*a* with the outermost portion of cam follower 52*a* forces the trim plate 36 to the left of this view. Cam lobe 50*c* nests in a valley of cam follower 52*c* to allow the movement of the trim plate 36. FIG. 13 also more clearly depicts the clearance between the trim punch 38 and the spool 44 which allows the trim punch 38 to be moveably connected to the punch guide plate 32.

Figure 14:
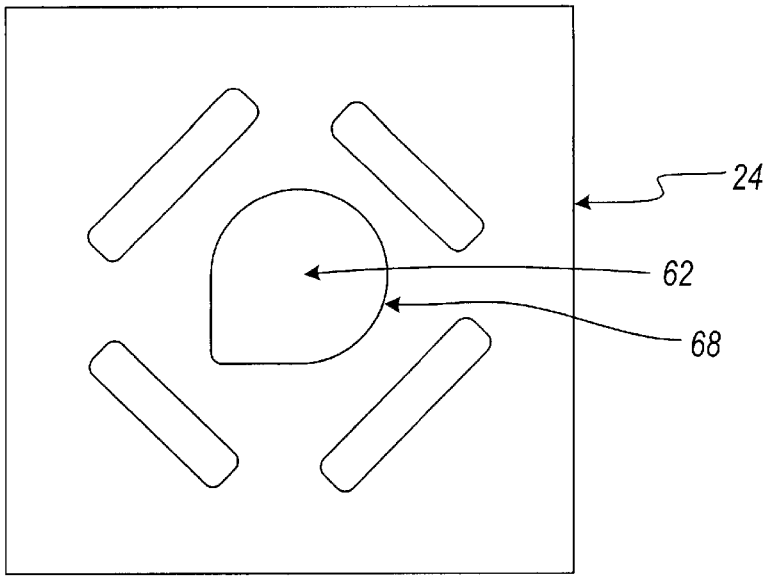
FIG. 14 is a top plan view of one embodiment of the die plate of the present invention.

Referring now to FIG. 14, one embodiment of the die plate 24 of the trim die 20 of the present invention is shown in top plan view. The die plate 24 includes a part cavity 62 for receiving the portion of a drawn part. As discussed above the part cavity 62 may have any variety of shapes. For example, the part shown is used only as a development tool to prove the ability of the die to trim the part as desired. The die plate 24 may also include cam punch cavities 64 for receiving the cam punches 30 if the stroke of the press would cause the cam punches 30 to travel into the die plate 24. The upper circumference of the part cavity 62 functions as the opposing trim edge 64 to the trim punch 38. As the trim punch 38 is indexed as described above, the lower surface of the trim punch passes over, and adjacent to, the trim edge 64. Typically, a clearance will be provided between the trim punch 38 and the trim edge 64 from about 2% to about 15% of the thickness of the material to be trimmed. More typically, the clearance will be between about 5% and about 10% of the material thickness. As with the other die pieces, additional holes or machined areas may be provided on the die plate 24, as necessary, to allow, for example, assembly of the die plate 24.

Figure 15:
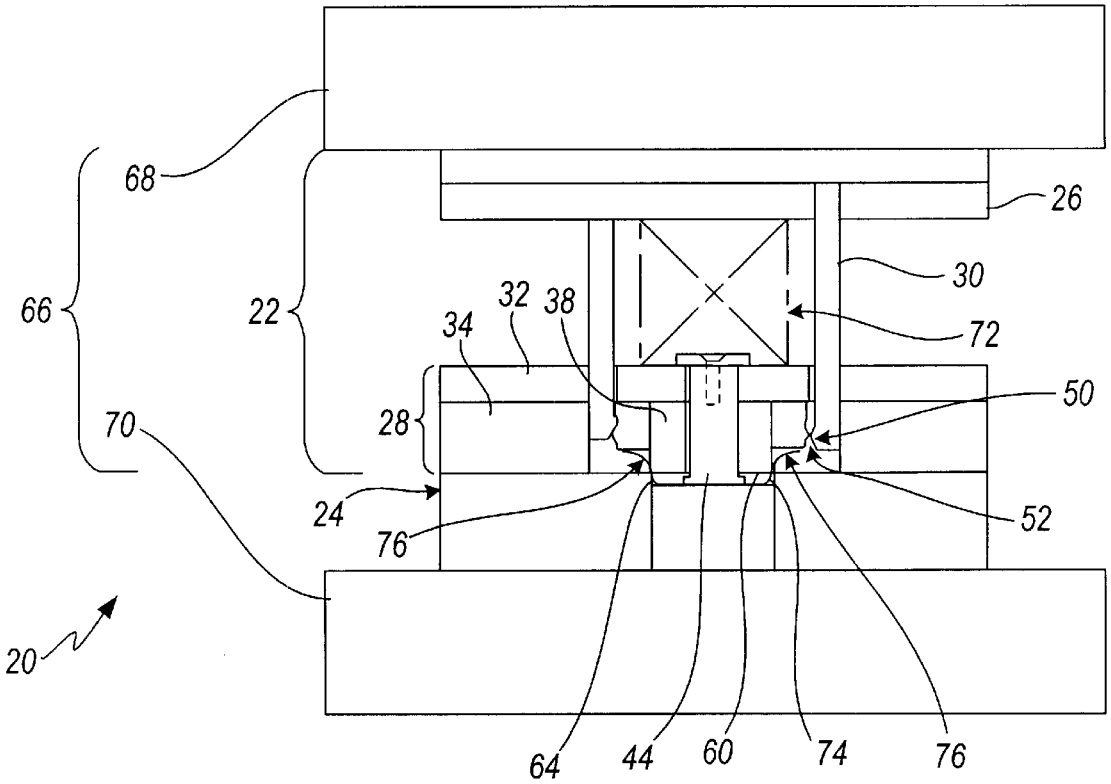
FIG. 15 is a cross-sectional view of one embodiment of the trim die of the present invention taken along the centerline of the die.

Referring now to FIG. 15, a trim die 20 of the present invention is shown in cross-sectional view. It is typical to mount a die such as the present invention in a die set 66. Such a die set 66 commonly includes an upper die shoe 68 and a lower die shoe 70. The upper die shoe 68 is connected to the ram of the press, while the lower die shoe 70 is connected to the bolster, or bed, of the press. In this embodiment, the punch portion 22 of trim die 20 is connected to the upper die shoe 68 by the punch plate 26 and the die plate 24 is connected to the lower die shoe 70. When the press is at top dead center, the stripper plate 28 is biased away from the punch plate 26 by springs 72 and constrained to a maximum distance by stripper springs or spools (not shown). As the press cycles downward, toward bottom dead center, BDC, the ram and the punch portion 22 of the trim die 20 approach the die plate 24. The part 74 to be trimmed is positioned at, or proximate to, the part cavity 62 of the die plate 24. At some point during the stroke of the press, the stripper plate 28 will contact the die plate 24, or the part 74 to be trimmed sitting on the die plate 24. The pilot 60, having a corresponding geometry, engages the drawn part 74 and nests with the drawn part 74 into the part cavity 62. At this point, further downward movement by the ram, and thus the punch plate 26, will overcome the biasing force of the springs 72 and the punch plate 26 will continue downward movement relative to stripper plate 28, as well as the die plate 24. The stripper plate 28, including the trim plate 36 and the trim punch 38, is now in a predetermined vertical relationship with the die plate 24.

As the ram continues its downward motion, the cam punches 30 move relative to the stripper plate 28. Eventually, the cam lobes 50 of the cam punches 30, in turn, will engage the corresponding cam followers 52 of the trim plate 36 and index the trim punch 38 in that relative direction. As the trim punch 38 passes over, and adjacent to, the trim edge 64, the portion of the excess material 76 is sheared between the trim punch 38 and the trim edge 64. As the ram continues downward, the remaining cam punches 30 engage the corresponding cam followers 52 and trim the remaining excess material 76 from the part 74. By the time the press cycle reaches bottom dead center, the excess material 76 is completely trimmed from the part 74. The excess material 74 travels, at most, approximately the displacement of the trim punch 38.

As the press begins to cycle upward toward top dead center, the biasing force of the springs is reinstated and the punch portion 22 of the trim die 20, including the stripper plate 28 in time. The excess material 76 and the part 74 can be removed from the die plate 24. In the case of a progressive die, the advancement of the strip will carry the trimmed excess material 76, which is still attached to the strip, out of the trim station. The part 74 may pass through the part cavity 62 into a receptacle below, or otherwise transferred away from, the die plate 24. Alternatively, a spring, or pneumatic or hydraulic cylinder, may force the part 74 out of the part cavity 62. The part may then be blown by air, or otherwise transferred, to a desired receptacle.

As can be determined from the foregoing description, the present invention has several advantages. Since the excess material 76 is subject to very limited movement during the trimming operation, the trim die 20 of the present invention can be used in progressive dies where similar prior art devices could not. The limited motion of the strip in the present invention prevents interference with alignment of the strip in other stations. Similarly, the trim die 20 of the present invention also facilitates use with other part transfer devices.

Further, motion of the trim edges of the present invention are limited to internal portions of the tooling. The present invention thus has the advantage of simplicity of construction and maintenance over similar prior art devices. Additionally, since the motion is internal to the die, danger to press operators by large, moving portions of the die is reduced. Moreover, the internal movement may provide the ability to trim a small drawn portion of a larger part in a die that includes additional operations.

Another advantage of the trim die 20 of the present invention is the ability to trim the entire circumference of a drawn part in a single stroke of the press. The trim die 20 of the present invention no longer requires other operations prior to the trimming operation to remove the entire amount of excess material. Additionally, the trim die 20 of the present invention may enable a part to be trimmed with a variety of circumferential geometries. Not only may nearly ever shape of a drawn part be trimmed, but also the trimmed edge may encompass more than one plane, e.g., scalloped edges or notches, based on the arrangement of the trim punch 38 and the trim edge 64 and the timing of the cam punches 30 with the cam followers 52.

For clarity purposes, the following list of components shown in the drawings and associated numbering is provided herein:

| Number | Component |
|---|---|
| 20 | cam trim die |
| 22 | punch portion |
| 24 | die plate |
| 26 | punch plate |
| 28 | stripper plate |
| 30 | cam punches |
| 32 | punch guide plate |
| 34 | trim plate carrier |
| 36 | trim plate |
| 38 | trim punch |
| 40 | trim plate cavity |
| 42 | trim plate aperture |
| 44 | spool |
| 46 | screw |
| 48 | dowel |
| 50 | cam lobe |
| 52 | cam follower |
| 53 | top surface of the die plate |
| 54 | cam punch apertures |
| 56 | cam punch recess |
| 58 | trim punch clearance hole |
| 60 | pilot |
| 62 | part cavity |
| 64 | trim edge |
| 66 | die set |
| 68 | upper die shoe |
| 70 | lower die shoe |
| 72 | spring |
| 74 | part |
| 76 | excess material |

It is understood that while the trim punch 38 and associated components are shown in the drawings as a teardrop shape, a myriad of other shapes are possible. Further, while various embodiments of the present invention have been shown and described in detail, it is apparent that modifications and adaptations of those embodiments will occur to those skilled in the art. However, it is to be expressly understood that such modifications and adaptations are within the scope and spirit of the present invention.

What is claimed is:

1. A die assembly adapted for trimming at least a portion of a circumference of a drawn part, comprising:

(a) a punch plate interconnected to a plurality of cam punches, said cam punches each having a longitudinal axis extending vertically, said plurality of cam punches each having a cam lobe;

(b) a die plate having a part recess sized to receive at least a portion of the drawn part, the upper circumference of the part recess forming an exterior trim edge;

(c) a stripper plate moveably interconnected to said punch plate and having a plurality of apertures for receiving said cam punches; and (d) a trim plate horizontally moveably mounted in said stripper plate, said trim plate having a plurality of lateral sides and a trim punch, wherein said cam punches respectively move said trim plate in a horizontal relationship with respect to the longitudinal axis of said cam punches by engaging said trim plate lateral sides with said cam lobes as said stripper plate is moved toward said punch plate, wherein excess material is trimmed from at least a portion of the circumference of the drawn part by the movement of said trim punch relative to said exterior trim edge.

2. A die assembly as claimed in claim 1, wherein said trim plate lateral sides have at least one cam follower formed thereon.

3. A die assembly as claimed in claim 1, further comprising a non-moving pilot punch positioned adjacent to said trim punch and connected to said stripper plate.

4. A progressive die adapted for drawing, forming and trimming a part from a strip of stock material, comprising:

a plurality of stations positioned in series to draw, shape, pierce or otherwise form a portion of said strip of stock material to form a drawn part; and at least one trimming station comprising:

(a) a punch plate having a plurality of vertically oriented cam punches interconnected thereto, said can-i punches each having a cam lobe;

(b) a die plate having a part recess sized to receive at least a portion of the drawn part, the upper circumference of the part recess forming an exterior trim edge;

(c) a stripper plate having a plurality of apertures and reciprocally engaged to said plurality of cam punches; and (d) a trim plate operably positioned within said stripper plate and moveable within a horizontal plane, said trim plate having a plurality of lateral sides and a trim punch, wherein said cam punches respectively move said trim plate horizontally by engaging said trim plate lateral sides with said cam lobes as said stripper plate is moved toward said punch plate, wherein excess material is trimmed from the drawn part by the movement of said trim punch relative to said exterior trim edge.

5. A progressive die as claimed in claim 4, wherein said trim plate lateral sides have at least one cam follower formed thereon.

6. A progressive die as claimed in claim 4, further comprising a non-moving pilot punch adjacent to said trim punch and connected to said stripper plate.

* * * * *